US011229816B2

(12) United States Patent
Durket

(10) Patent No.: US 11,229,816 B2
(45) Date of Patent: Jan. 25, 2022

(54) ADJUSTABLE TRANSVERSE RESISTANCE EXERCISE MACHINE

(71) Applicant: Anthony Durket, San Diego, CA (US)

(72) Inventor: Anthony Durket, San Diego, CA (US)

( * ) Notice: Subject to any disclaimer, the term of this patent is extended or adjusted under 35 U.S.C. 154(b) by 0 days.

(21) Appl. No.: 16/992,390

(22) Filed: Aug. 13, 2020

(65) Prior Publication Data

US 2020/0376318 A1 Dec. 3, 2020

Related U.S. Application Data

(63) Continuation-in-part of application No. 16/368,241, filed on Mar. 28, 2019, now Pat. No. 10,814,155, (Continued)

(51) Int. Cl.

| | |
|---|---|
| ***A63B 21/04*** | (2006.01) |
| ***A63B 24/00*** | (2006.01) |
| ***A63B 23/12*** | (2006.01) |
| ***A63B 23/04*** | (2006.01) |
| ***A63B 21/055*** | (2006.01) |
| ***A63B 21/00*** | (2006.01) |
| ***A63B 71/06*** | (2006.01) |

(Continued)

(52) U.S. Cl.

CPC .... *A63B 21/0414* (2013.01); *A63B 21/00069* (2013.01); *A63B 21/0552* (2013.01); *A63B 21/4034* (2015.10); *A63B 21/4035* (2015.10); *A63B 23/0405* (2013.01); *A63B 23/1209* (2013.01); *A63B 24/0087* (2013.01); *A63B 21/0428* (2013.01); *A63B 21/0442* (2013.01); *A63B 21/078* (2013.01); *A63B 21/16* (2013.01); *A63B 21/169* (2015.10); *A63B 21/4045* (2015.10); *A63B 71/0622* (2013.01); *A63B 2023/0411* (2013.01); *A63B 2071/0627* (2013.01); *A63B 2071/0694* (2013.01); *A63B 2208/0204* (2013.01); *A63B 2225/093* (2013.01); *A63B 2225/50* (2013.01); *A63B 2230/01* (2013.01); *A63B 2230/06* (2013.01); *A63B 2230/30* (2013.01); *A63B 2230/40* (2013.01)

(58) Field of Classification Search

CPC ..... A63B 1/00; A63B 21/0069; A63B 21/02–0557; A63B 21/1618–1627; A63B 21/4034–4035; A63B 24/0087; A63B 71/0622; A63B 2225/093; A63B 2225/50

See application file for complete search history.

(56) References Cited

U.S. PATENT DOCUMENTS

| | | | |
|---|---|---|---|
| 726,095 | A | 4/1903 | Nightingale |
| 3,958,803 | A | 5/1976 | Geisselbrecht |

(Continued)

*Primary Examiner* — Jennifer Robertson

(74) *Attorney, Agent, or Firm* — Berenato & White, LLC

(57) ABSTRACT

An adjustably tensioned, transverse-suspended elastic element exercise device is disclosed. The transverse element is suspended between rigidly mounted frame or arm elements and sized so as to enable full range of motion exercises. The tension and height of the transverse elastic member can be adjusted to accommodate varying exercise levels and positions. The assembly may include handgrips and attachments to augment workouts. Electronic adjustability, metrics, programmability and Internet connectivity enhance the user experience. A method of using the device is also disclosed.

9 Claims, 12 Drawing Sheets

Related U.S. Application Data which is a continuation of application No. 15/593,047, filed on May 11, 2017, now Pat. No. 10,252,096.

(60) Provisional application No. 62/336,612, filed on May 14, 2016.

(51) Int. Cl.
*A63B 21/078* (2006.01)
*A63B 21/16* (2006.01)

(56) References Cited

U.S. PATENT DOCUMENTS 4,241,914 A 12/1980 Bushnell
5,016,874 A 5/1991 Boardman
5,395,296 A 3/1995 Webster et al.
5,823,925 A 10/1998 Webster et al.
6,267,711 B1 * 7/2001 Hinds ..... A63B 1/00 482/121
7,465,259 B2 12/2008 Mok
7,494,450 B2 2/2009 Solomon
7,689,378 B2 3/2010 Kolen
7,785,242 B2 8/2010 Solomon
7,850,585 B1 12/2010 Barboza
7,896,786 B1 3/2011 Osbourne
8,021,273 B2 9/2011 Kopp
8,088,045 B2 1/2012 Hoffman
8,351,773 B2 1/2013 Nasiri et al.
1,112,114 A1 9/2014 Caines
8,852,062 B2 * 10/2014 Dorsay ..... A63B 21/00069 482/121
9,072,940 B1 7/2015 Gutierrez
9,895,564 B1 2/2018 Katz
2013/0109547 A1 5/2013 Johnson
2014/0031181 A1 * 1/2014 Agostini ..... A63B 21/0552 482/129
2014/0087928 A1 * 3/2014 Luedeka ..... A63B 21/0552 482/130
2014/0128228 A1 5/2014 Bonomi
2014/0148318 A1 5/2014 Sanders
2014/0371038 A1 12/2014 Markowitz
2015/0265903 A1 9/2015 Kolen et al.
2016/0361583 A1 12/2016 Nguyen
2017/0072242 A1 3/2017 Drain, II

* cited by examiner

ADJUSTABLE TRANSVERSE RESISTANCE EXERCISE MACHINE

The present application is a non-provisional utility patent filing claiming the benefit of prior provisional filing U.S. Ser. No. 62/336,612, filed May 14, 2016, and U.S. application Ser. No. 15/593,047, filed May 11, 2017, now U.S. Pat. No. 10,252,096, and U.S. application Ser. No. 16/368,241, filed Mar. 28, 2019, the entire contents of each are incorporated herein by reference thereto.

FIELD OF THE INVENTION

The present invention relates to an exercise apparatus, and more particularly to an exercise apparatus including an elastic resistance element or band suspended transversely between two frame elements. The elevation and lateral slope of the elastic element, as well as the relative tension within the element, may be freely adjusted. As such, a variety of resistance exercises may be accomplished by a user from various attitude and positional perspectives.

BACKGROUND OF THE INVENTION

Exercise, as opposed to mere human activity, has been a part of history almost since records have been kept. The Olympic Games being, perhaps, the best historic example of vigorous human activity with no goal aside from competition one person to another, or against a separate metric, i.e., distance or time. In this regard, inasmuch as humankind has sought to improve their performance in such contests, and to enhance their physical well-being generally, exercise has played a role for many in their pursuit of life. This role of exercise in society has generally ebbed and increased in accord with access to leisure. In an agricultural community before the industrial age, it would likely have been unnecessary, and the leisure time likely unavailable, to pursue a separate course of exercise or training. In the early industrial age, likewise, many vocations still required considerably physical dexterity and stamina. However, as the post-industrial revolution has immerged, both with shorter work-weeks and less physically taxing work, exercise has become its own industry.

Each January we are collectively inundated with offers to help us achieve our goals of weight-loss, strength, or other certification of physical accomplishment. Trends, thru the years, have abounded for both exercise technique, diet, and nutrition. Various devices have proliferated and receded, i.e., universal gyms, Nautilus, Bow-Flex, etc., various team and solitary activities, i.e., jogging, tennis, golf, yoga, etc., and some extreme variations on them, i.e., tough mudders (jogging and obstacles with mild electrocution), Bikram (hot) yoga, Cross-Fit (Olympic weight lifting plus exhaustive cardio). Diet, likewise, can proceed to the extremes, i.e., paleo, no carbs at all, all-fruit, no animal based products, only organic, etc.

The short-coming in any of the foregoing is a combination of access and complexity. For some, difficult access is reason enough to be spurred to be a part of the group, i.e., exclusivity, climbing Everest or running thru Death Valley, is but a small fraternity. For others, even going to a gym next-door can be either intimidating and/or too much trouble or simply un-appealing. Likewise, for food and nutrition, not having access to what is needed at the right moment, can unravel months of effort. As far as apparatus: some exercise devices simply defy understanding, even to the well initiated and sophisticated. Many devices are bought, but few are used.

Therefore, a need exists for an exercise apparatus that is simple to comprehend, use, is convenient and uses today's technology to offer a smarter more efficient way to build strength.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to a first aspect of the invention, a transversely suspended elastic element, band, or wire is provided; the element extending side-to-side from sturdy upright stanchions or extended arm members. The element may, itself, be resilient, i.e., a bungee-type, or it may be, instead, relatively non-resilient and attached at each end thereof to resilient elements, i.e., spring or elastic elements thru a pulley and belt, etc., associated with or within the stanchions or arm members. The height of the element, at each lateral extent thereof associated with each stanchion or extended arm member may be adjusted, and the resilience, or resistance of the element, to motion transverse to the element may adjusted according to the exercise motion being performed or the resistance desired. A suggested exercise sequence or sequences could be pre-programmed, in accord with a specific user, into the device to guide a user throughout a regimented workout via webcast community workout sequences, adjusting band height and tension in timed intervals in accord with exercise and motion and instruction.

The benefits of elastic resistance vs. weights or gravity-based strength building: 1) Muscles adapt and react; 2) More functional movements; and, 3) Better mimics the strength curve of muscles.

The differences between the invention and conventional exercise devices are many. To wit: Transverse band vs. linear resistance bands. Infinitely adjustable resistance (tension) and height, allows for incremental adjustability of tension (vs just a thicker or thinner band). All the benefits of elastic resistance strength training without pausing to swap plates. Electronics—to automatically adjust, monitor and optimize workouts. Easy to use—ergonomic, simple auto or manual adjustment, gentle, not intimidating. Simplicity: few moving parts vs. dozens in many exercise machines. Physiological benefits of transverse vs. linear resistance and weights. New kinds of workouts that are gentler, faster, multi-dimensional. Gentler workout for youth, older, disabled and PT patients. Takes up less space as comparable weight/resistance machines. Weighs less than full-body workout machines, less shipping cost. Simple design is less intimidating and visually appealing. Saves time by adjusting quickly and easily. More Efficient—many exercises can be doubled—pushing and pulling in one movement thereby saving workout time. Changing resistance/weight is safe and quick. Installs easily in home, studio, or gym facility. Easy to use, multiple exercises from one position. More gentle, natural way to build tone and muscle. Speeds up the loading phase of exercise (vs. weight machines). Vector force in all planes because they are not gravity-dependent (vs. weight machines). Electronics—Adjustment, Feedback, Health Metrics, Preset exercise programs, Internet connectivity, video instruction. Apps for smart devices, (smart phone, tablet, watch).

Other aspects of the invention, including apparatus, devices, systems, converters, processes, and the like which constitute part of the invention, will become more apparent upon reading the following detailed description of the exemplary embodiments.

BRIEF DESCRIPTION OF THE DRAWINGS

The exercise apparatus and methods associated therewith are described with reference to the following figures. These same numbers are used throughout the figures to reference like figures and components.

DETAILED DESCRIPTION

Figure 1:
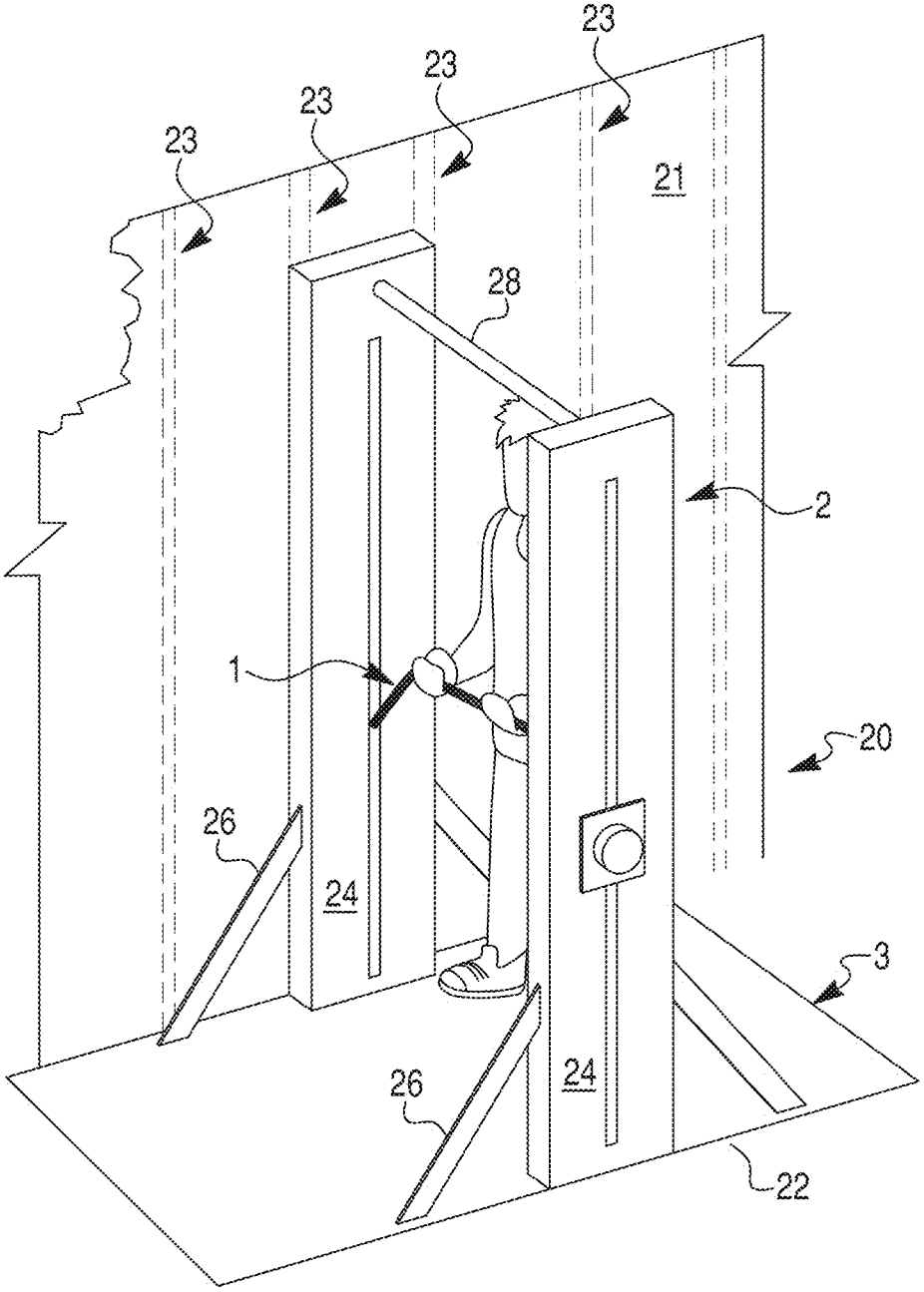
FIG. 1 is a perspective view of an exercise apparatus in accord with the present invention with a user in one use position.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "upper", "lower", "right", "left", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" and "an" as used in the claims means "at least one" and the word "two" as used in the claims means "at least two".

In the present description, certain terms have been used for brevity, clearness and understanding. No unnecessary limitations are to be inferred therefrom beyond the requirement of the prior art because such terms are used for descriptive purposes only and are intended to be broadly construed. The different apparatus and methods described herein may be used alone or in combination with other systems and methods.

FIG. 1 shows an exercise apparatus 20 in accord with the present invention. This embodiment shows the basic elements of up right frame or stanchion elements 24, connected respectively to a floor 22 engaging member 3 at the lowermost extent and a transverse brace 28 at the uppermost extent. The uprights 24 are rigidly held against forward and back movement by braces 26. A thick elastic element 1 is suspended transversely between the two uprights 24. An alternative assembly would include a variant where one, or both, of the upright elements 24 are incorporated into an existing or newly constructed wall 21; i.e., a passageway in a home. The upright elements 24 would be associated with the stud elements 23 already in a conventional wall 21. Likewise, the upper transverse brace 28 could form a part of the ceiling stud(s) system. In the instance where only one of the upright members is secured to or forms a part of an existing wall, the other upright member may be free standing away from the wall, and suspended rigidly, in a position parallel to the wall, at both top and bottom of the upright member. This rigid suspension can be provided by a direct floor/ceiling interface or be provided from arm or brace elements extending from the wall.

The elastic element 1 can be an off-the-shelf bungee type product, or it can be a specified elastic element, i.e., a particular diameter and modulus of elasticity, more resistant to UV, if used outdoors. The relative resistance to stretching can be identified by virtue of a color coding, i.e., red is tough, white is less severe, and blue is easy, or labelling, i.e., 1 is easy, up to 10 as most resistant. The frame 2 and its constituent elements, 24, 26, 28, can be a variety of dimensions, but the goal is that a sufficient range of motion is possible for the exercise being undertaken. The relative size of the frame 2 would have to account for physical constraints of the user location, however. The frame 2 and associated base 3, if portable, need to be sufficiently resistant to the motion of the user in exercising, but the user standing upon the base 2 will help in this regard.

This transverse adjustable, i.e., height and tension, configuration enables forces and resistance transverse to the tensioned band as opposed to linear resistance along the band. The transverse force is more natural, uniform in accumulation of resistance, and is gentler to engage and use.

This is especially the case when a user engages at more than one location along the band using the hand and foot-strap devices disclosed herein.

Figure 2:
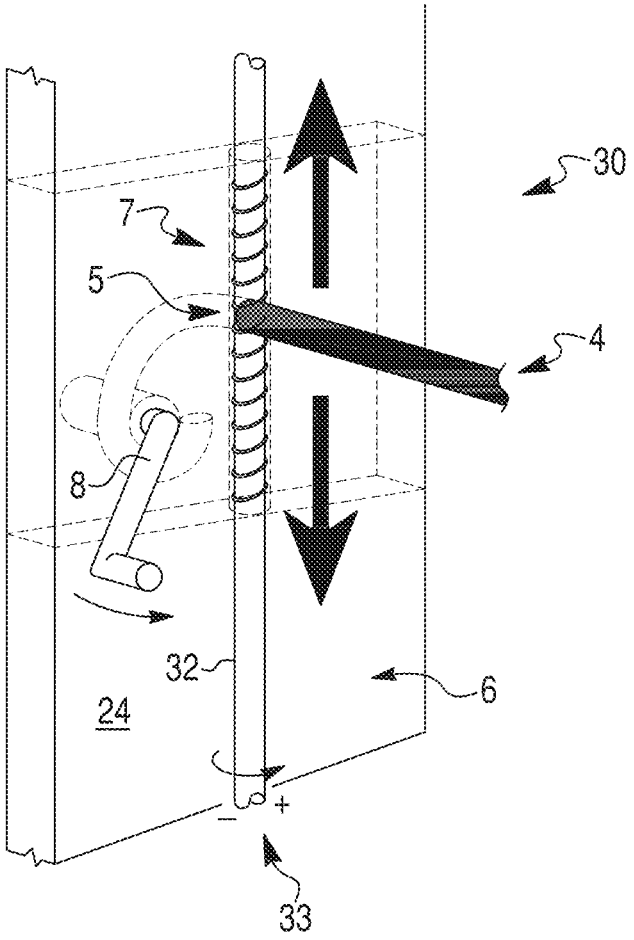
FIG. 2 is a close-up of a worm gear driven trolley-based height adjustment mechanism for the wire element, shown as a part of a stanchion.

FIG. 2 shows a trolley type 30 height adjuster for the transverse lateral band or wire 4. This specific embodiment shows a worm gear type of height adjuster 7, including a trolley 5 equipped with an internal spiral cavity, or retained nut(s), for receiving the worm gear 33 as it turns to adjust the trolley location upwardly or downwardly 32. Such a height adjuster might also include a pulley arrangement to lift or lower the respective trolley(s) 5. The worm gear, in this embodiment, could be manually driven or electrically driven using a step-motor to sense revolutions and adjust height accordingly. The trolley 5 also includes a tensioning system 8 to increase and decrease the tension in the band 4. The tensioning system 8 is a simple reel and crank system, like a tennis net tension adjuster, with a position fixing and releasing ratchet and pawl.

Figure 3:
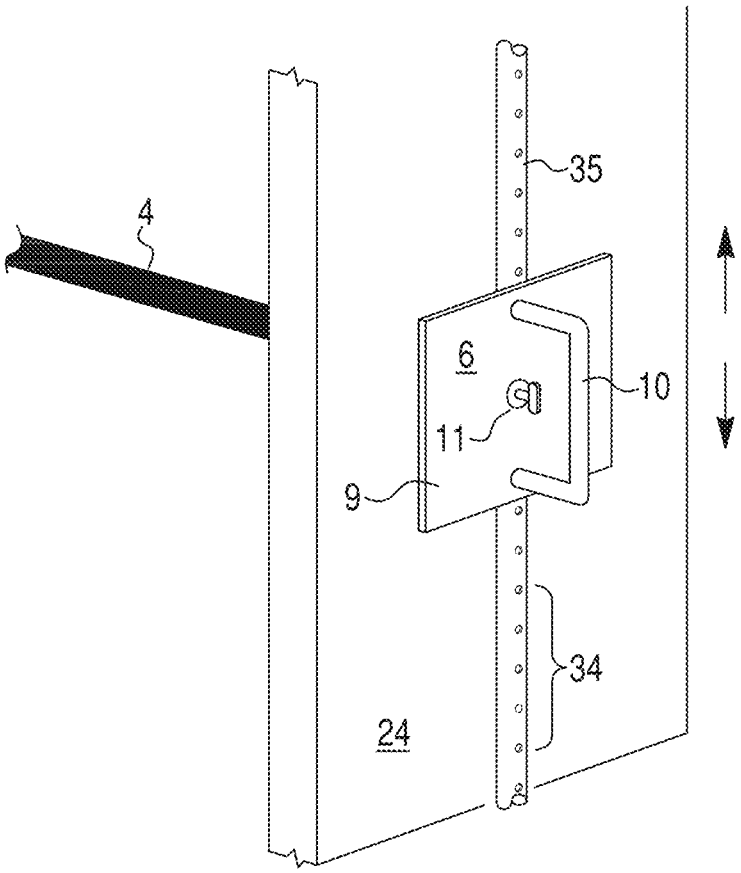
FIG. 3 is a close-up view of a manually adjustable height and wire tensioning system associated with an embodiment of the present invention.

FIG. 3 shows another embodiment 9 of the position adjusting system for the band 4. The height is set manually using a pin 11 that is biased inwardly via a spring. The trolley 5 is moved using handle 10 up and down with the pin or peg fixing the height according to the holes 34 located in frame element 35 (here shown as an integral tube element).

Figure 4:
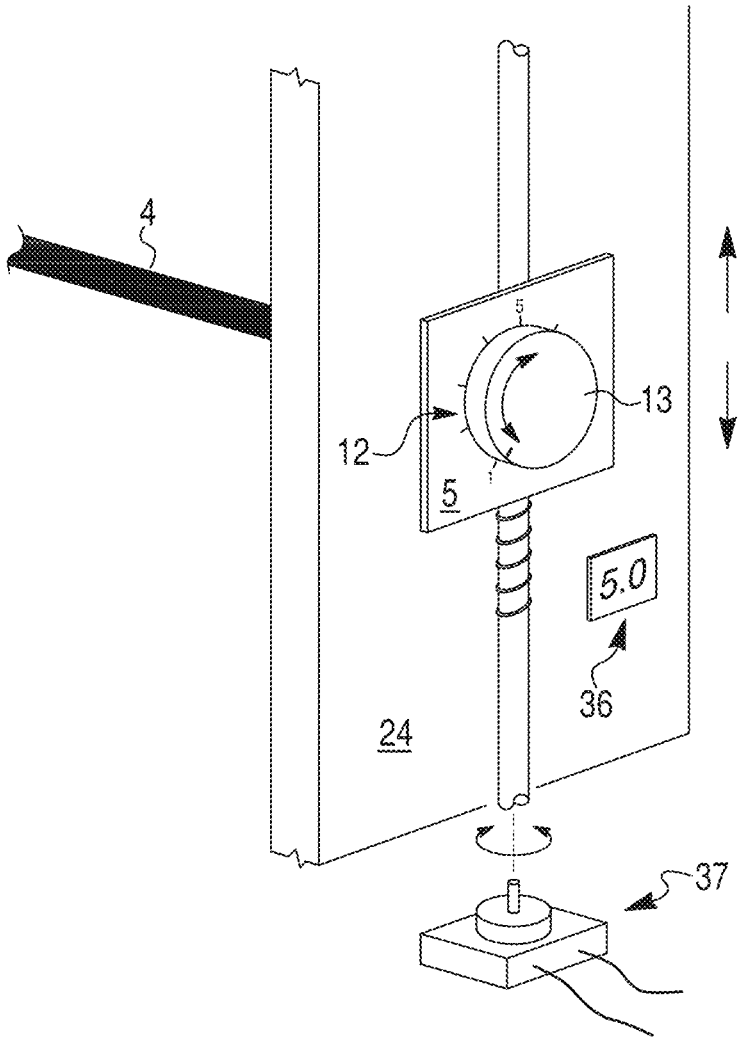
FIG. 4 is a close-up view of an alternate embodiment of a twisting tensioning system for the wire of the present invention.

FIG. 4 shows another embodiment of a tensioner 12 wherein a knob 13 is rotated to increase or decrease tension in the wire or band 4. Tension in the band may be adjusted incrementally to vary resistance in the band from a few pounds to few hundred pounds. The resistance may be measured according to a metric, i.e., 1-10, or be listed in amounts corresponding to poundage, i.e., 10-100 lbs. The tensioning system is effective to not over tension the band, regardless of its exact make-up, i.e., bungee type, wire and spring combination. The resistance level may be indicated on an electronic display or via a dial type indicator. This version could also be automated using an electronic indicator 36 to show a specified height above the floor when reached by stepper motor.

The height adjustment and tensioning may be contained within the trolley 5, i.e., the trolley 5 could have an electronic motor, powered via a rechargeable battery element, and a user simply activates the motor using a switch until the desired height is achieved. The tensioning device located in the trolley 5 likewise could have a similar, but high torque motor, i.e., like a portable nut driver, and tension could be adjusted by winding the band 4 around a reel until desired tension is achieved. The band 4 would be directed to such a reel using a fairlead to ensure integrity of the band in use as it is repeatedly tensioned and released. The band 4 could also be a wire, tensioned by a separate resilient element located in the trolley or, through a pulley and cable (or belt or chain), elsewhere in the frame upright 24. The remote resilient element could, itself, be a bungee type elastic element, or a spring (wound, coil, or torsion) element.

The band element 4 may also be subject to twist tensioning. One side of the band is prevented from twisting in its mount to the trolley 5, while the other side may rotate the band 4 until desired resistance to lateral/transverse motion is achieved in the band 4. Again, a ratchet and pawl type of rotation securing element may be used for manual versions, whereas an electric motor may be used for auto adjusting versions. As an alternative, the uprights may be positioned further apart to increase tension in the band. A turnbuckle device could be incorporated into the top and bottom transverse braces, and the distance therebetween could be expanded or reduced to respectively increase or decrease tension in the band.

Figure 5:
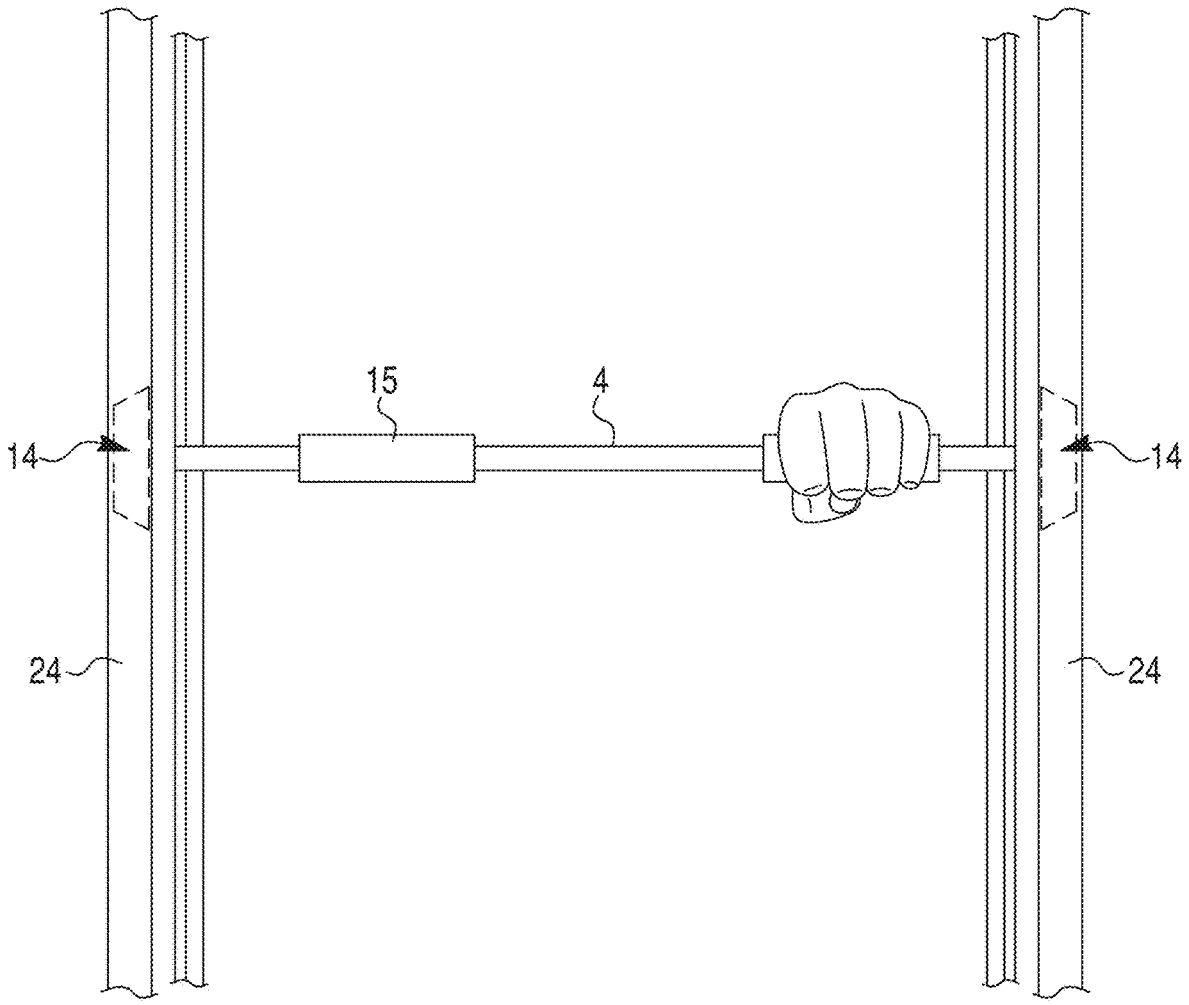
FIG. 5 is a side view of an apparatus in accord with the invention shown at identical heights side to side between the stanchions, along with the use of sliding hand grips.
Figure 6:
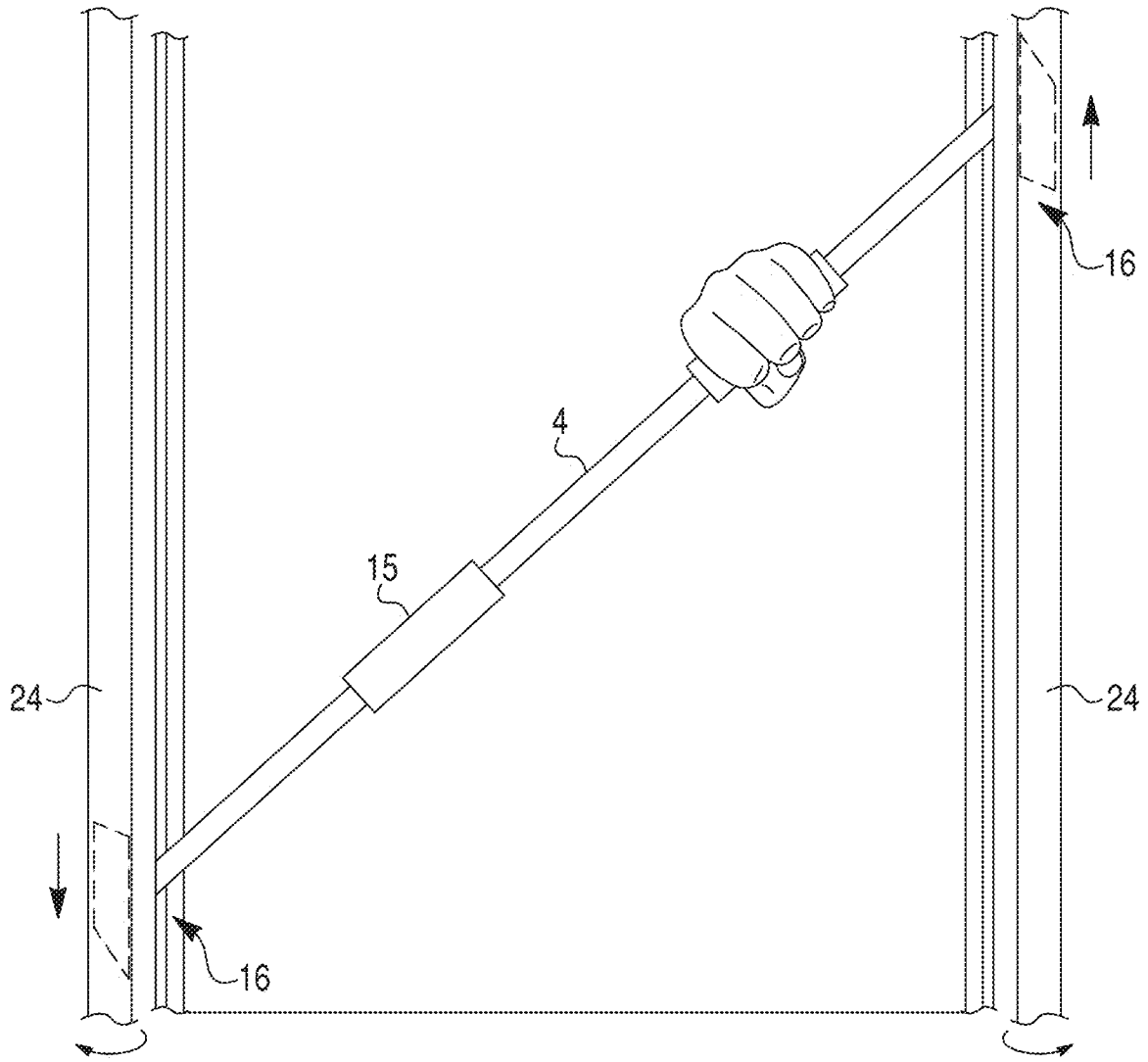
FIG. 6 is a side view of the apparatus showing disparate heights of the respective end points of the suspended wire.

FIG. 5 shows the band element positioned in a horizontal cast 14. This position is suitable for many exercises and, by virtue of height adjustment, can be used for squats, bench press, curls, tri-cep extensions, depending on height. Handgrips 15 support proper grip with a user's hands and may include vital sign monitoring features. For motions across the body, FIG. 6 shows a band 4 in a non-horizontal orientation 16 where cross body motion purchase on the band through handgrips 15 may be achieved.

Figure 7:
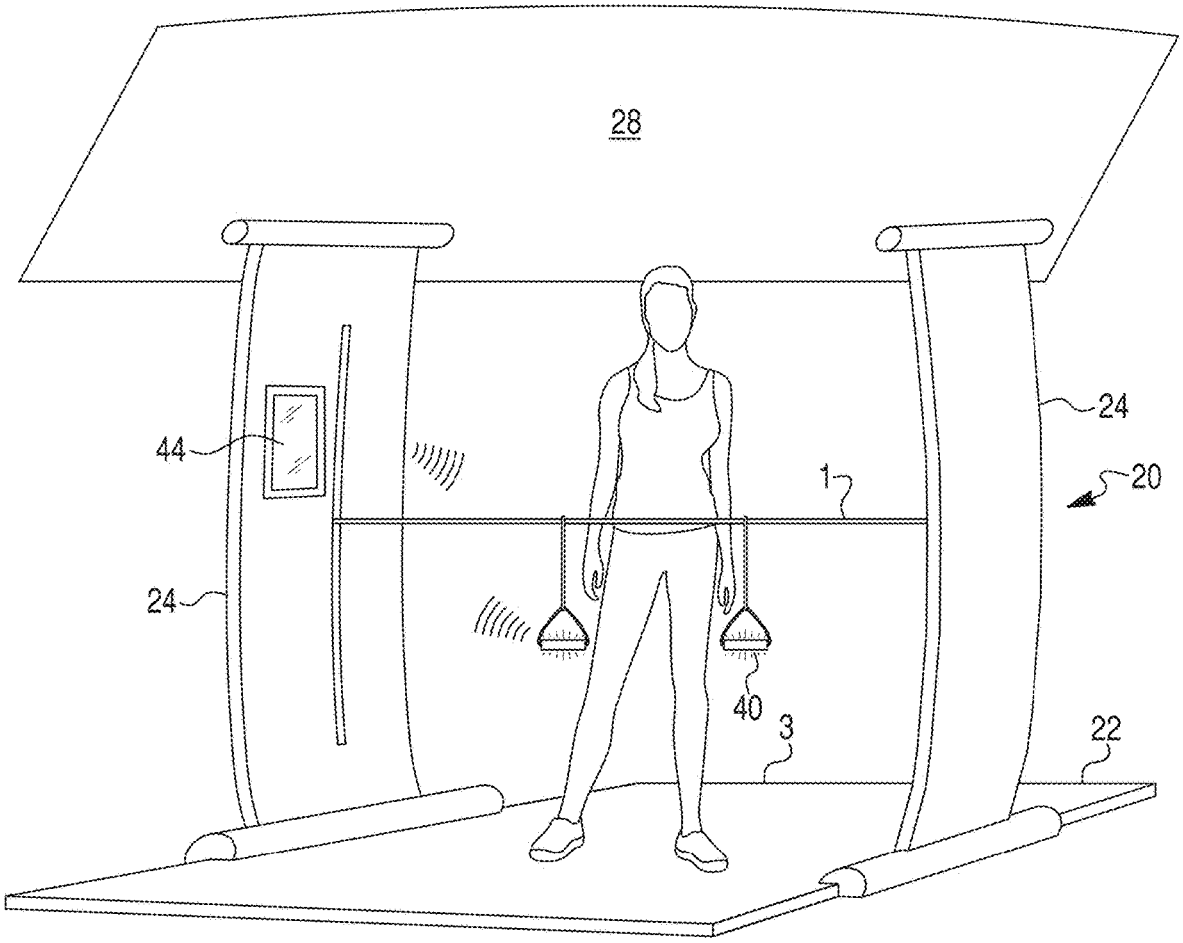
FIG. 7 is a perspective view of a full-size frame version of the present wire exercise apparatus.

FIG. 7 shows a full frame idealized version of the tension adjustable transversely extended wire exercise device 20 according to the present invention. The frame elements 24, 28, and 3 are incorporated into an enlarged surround in a passageway or standalone. An elastic element 1 is shown suspended horizontally between the upright lateral elements of the frame. The trolley 5 height and tension adjustment features are hidden within the stanchions 24. In addition, a single control panel 44 is shown that displays and controls all aspects of the height, tension, and exercise routine. It may, optionally, have Internet capability for reporting to an exercise club, or monitoring medical professional, with respect to the workouts being performed or stored. The electronics may also include monitoring of heart rate, blood pressure, etc., provided through, for example, electronic signal sending handgrips for measuring such vital signs of the user. The fully featured unit would include an assortment of accessories 40 (optionally including an electronic interface for checking user vital signs) for engaging the elastic element 1. Here a hanging handgrip device is shown equipped with WiFi or Bluetooth for sending info to the control panel. An example of such interactivity and connectivity for a device that could be adapted to the present invention is shown in US 2015/0265903 A1, which is herein incorporated by reference. U.S. Pat. Nos. 8,351,773 and 7,689,378, are each also incorporated herein by reference, as disclosing smart phone app linked MEMS devices. The hand and foot grips herein could be equipped with the various micro electromechanical systems (MEMS) disclosed therein and adapted into a reporting system for a social network devoted to exercise. Similarly, a complete device, incorporating connectivity and biometrics is disclosed in U.S. Pat. No. 8,852,062 B2, also incorporated herein by reference. An adjustable bench (not shown), having height and rake variability, would also likely be included. The user figure, about 5'6" tall, is provided to show relative scale. The fully framed device would be about 6-7 feet wide and about 7-8 feet tall, e.g., sufficiently sized to enable full range of motion exercise.

Figure 9:
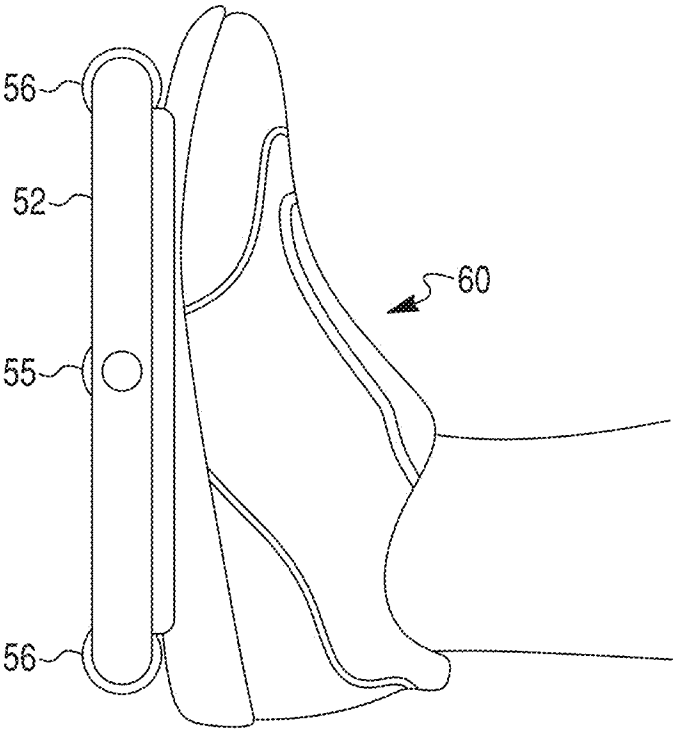
FIG. 9 is a side view of the foot engaging assembly shown in FIG. 8.
Figure 8:
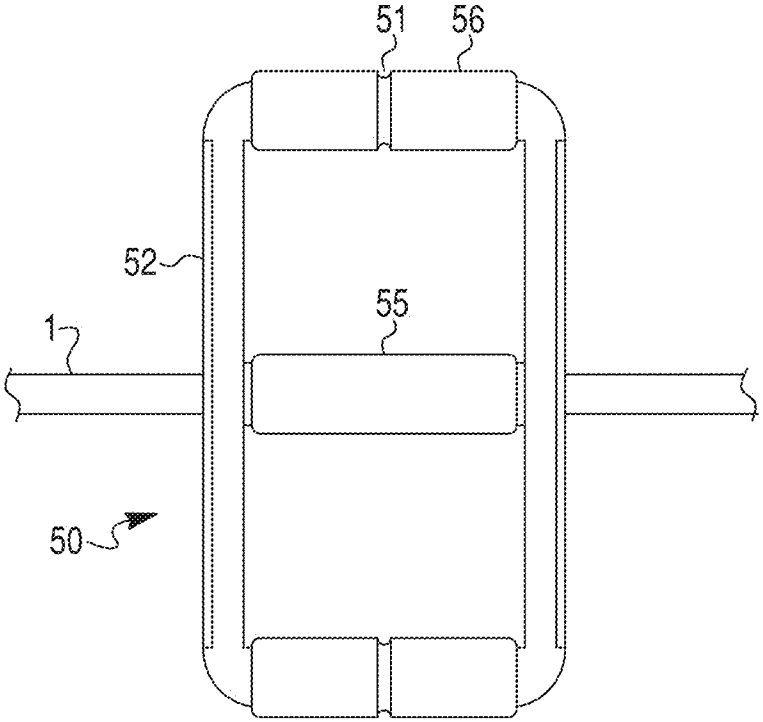
FIG. 8 is a plan view of a foot engaging assembly for assisting in use of the wire device shown in the preceding figures.

Additional devices for engaging the elastic element 1 are shown in FIGS. 8 and 9. This engaging device 50 is for both foot and hand use. The handgrip 55 is shown towards the center, while stirrup elements 52 extend outwardly to end frame elements 51, which is shown equipped with a soft grip(s) 56 to enhance grip between the user foot 60, the engaging device 50, and the suspended elastic element 1.

Figure 10:
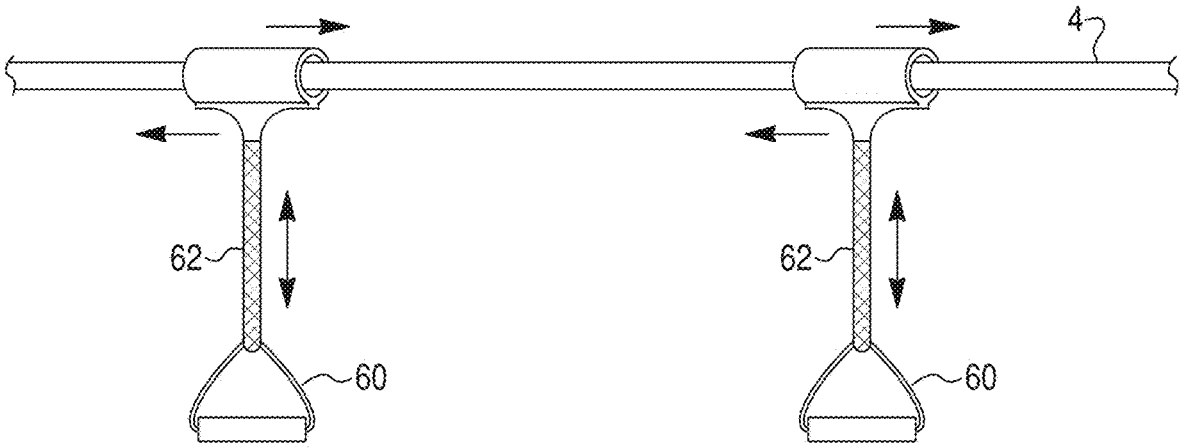
FIG. 10 is a handle accessory for engaging the apparatus transverse element.

FIG. 10 shows handles 60 with a short length of elastic 62 that is attached to the band 4. What makes this different from just using available resistance band 4 with handles is the when they are attached to the band 4, its transverse flexibility creates a longer stretch, lengthening the resistance benefits of the exercise.

Figure 11:
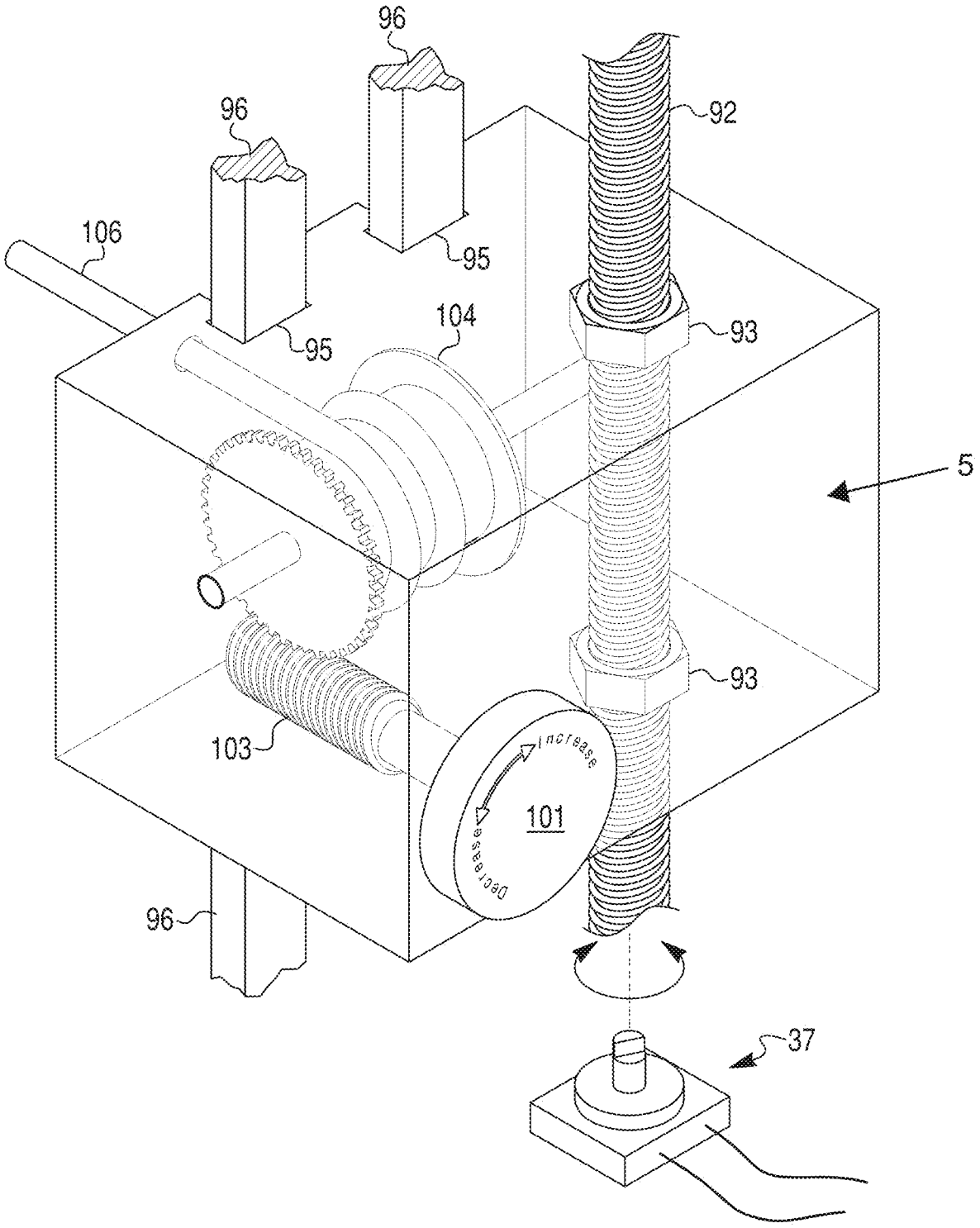
FIG. 11 shows more details of a height and tensioning adjusting trolley associated with the present invention.

FIG. 11 shows additional details of a trolley 5 from FIG. 2. In FIG. 11, the trolley is show as a rectilinear form with channels 95 on one side adapted to accept and slide along vertical rails 96. The rails 96 could be standalone and perform, themselves, as stanchion elements, but are more likely mounted to a surface or the stanchions themselves.

The channels are shown on the same side as the bungee 106 entrance/exit from the trolley, but could also be on a forward end, rearward, or on either side of the vertical worm ear 92. The vertical worm gear 92 is shown here engaging the trolley using a retained nut 93 structure. The nuts 93 are embedded into the trolley structure and engage the worm gear 92, as it rotates, so as to raise and lower the trolley when the worm gear is activated using stepper motor 37. The tensioning system here is manually operated by a user. A twist of knob 101 either clockwise or counterclockwise turns worm gear 103 which, in turn, rotates reel drum 104 equipped with a cog on an end thereof matched to worm gear 103. Bungee 106 is wound onto reel drum 104 and increases or decreases tension accordingly. The worm gear 103 could also be electrically driven and knob 101 could simply act as a switch to increase/decrease tension in bungee 106.

Figure 12:
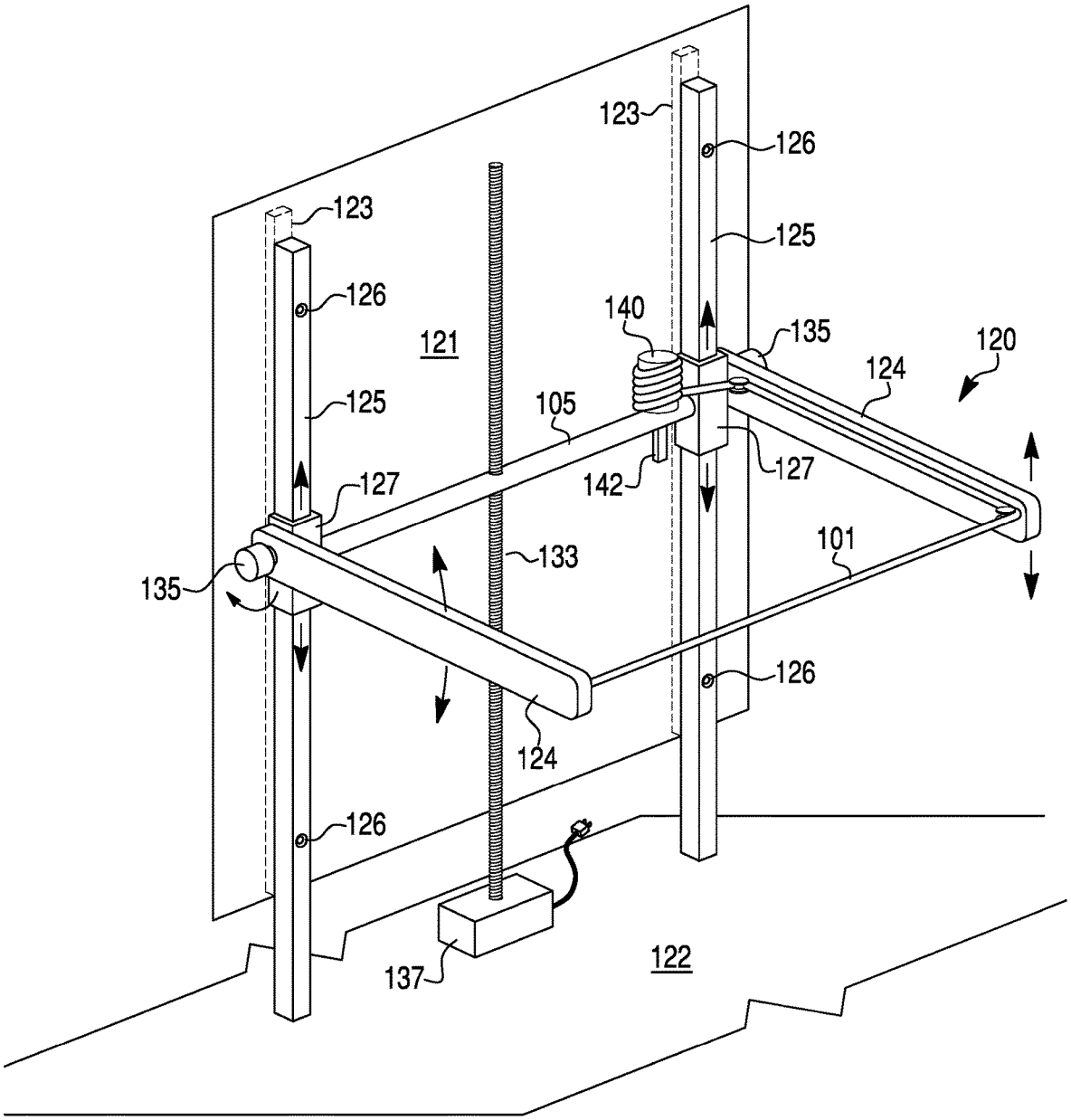
FIG. 12 is a schematic showing a single wall mounted exercise device having extended arm elements using a variable tension transverse elastic element.

FIG. 12 shows an alternative embodiment of an exercise apparatus 120 in accord with the present invention. This embodiment shows the basic elements of apparatus 120 including a pair of frame or stanchion elements 125, functioning as guide members for sliding elements 127, connected to a wall 121, and underlying studs 123 via fasteners 126, and resting on (optionally), a floor 122. The elements 125 are rigidly held against forward and back and side-to-side movement by stud elements 123 or other secure wall mount. The elements 125 may themselves form a part of a self-contained wall mounted frame. A thick elastic element 101 is suspended transversely between the two rotatively extended arms 124 that can rotate upwardly or downwardly into a stowed position against the wall 121. Clamps 135 prevent the rotative arms 124 from altering position in use, when the clamps are tightened, or otherwise locked/snapped (i.e., using a spring biased detent mechanism), into position, following rotation of the arms 124 into a use position at a particular height.

The elastic element 101 can be an off-the-shelf bungee type product, or it can be a specified elastic element, i.e., a particular diameter and modulus of elasticity, more resistant to UV, if used outdoors. The relative resistance to stretching can be identified by virtue of a color coding, i.e., red is tough, white is less severe, and blue is easy, or labelling, i.e., 1 is easy, up to 10 as most resistant.

This transverse adjustable, i.e., height and tension, configuration enables forces and resistance transverse to the tensioned band 101 as opposed to linear resistance along the band in the same way as the other embodiments described herein. The transverse force is more natural, uniform in accumulation of resistance, and is gentler to engage and use. This is especially the case when a user engages at more than one location along the band using the hand and foot-strap devices also disclosed herein.

In this embodiment a single transverse member 105, subtended at clamp/detent 135 equipped slider elements 127, is shown as the height adjuster for the transverse lateral band or wire 101. This specific embodiment shows a worm/screw gear 133 type of height adjuster, engaging transverse member 105 which is equipped with an internal spiral cavity, or retained nut(s), for receiving the worm gear 133 as it turns to adjust the transverse element 101 location upwardly or downwardly via slider elements 127 guided along on frame elements 125. The worm gear 133, in this embodiment, could be manually driven or electrically driven using a step-motor 137 to sense revolutions and adjust height accordingly. The transverse member 105 also includes a tensioning system 140, at an end thereof, to increase and decrease the tension in the band 101. The tensioning system 140 shown is preferably an electrical motor 142 driven reel that, when rotated, tensions or loosens the band 101, through pulleys, like a tennis net tension adjuster.

Figure 13:
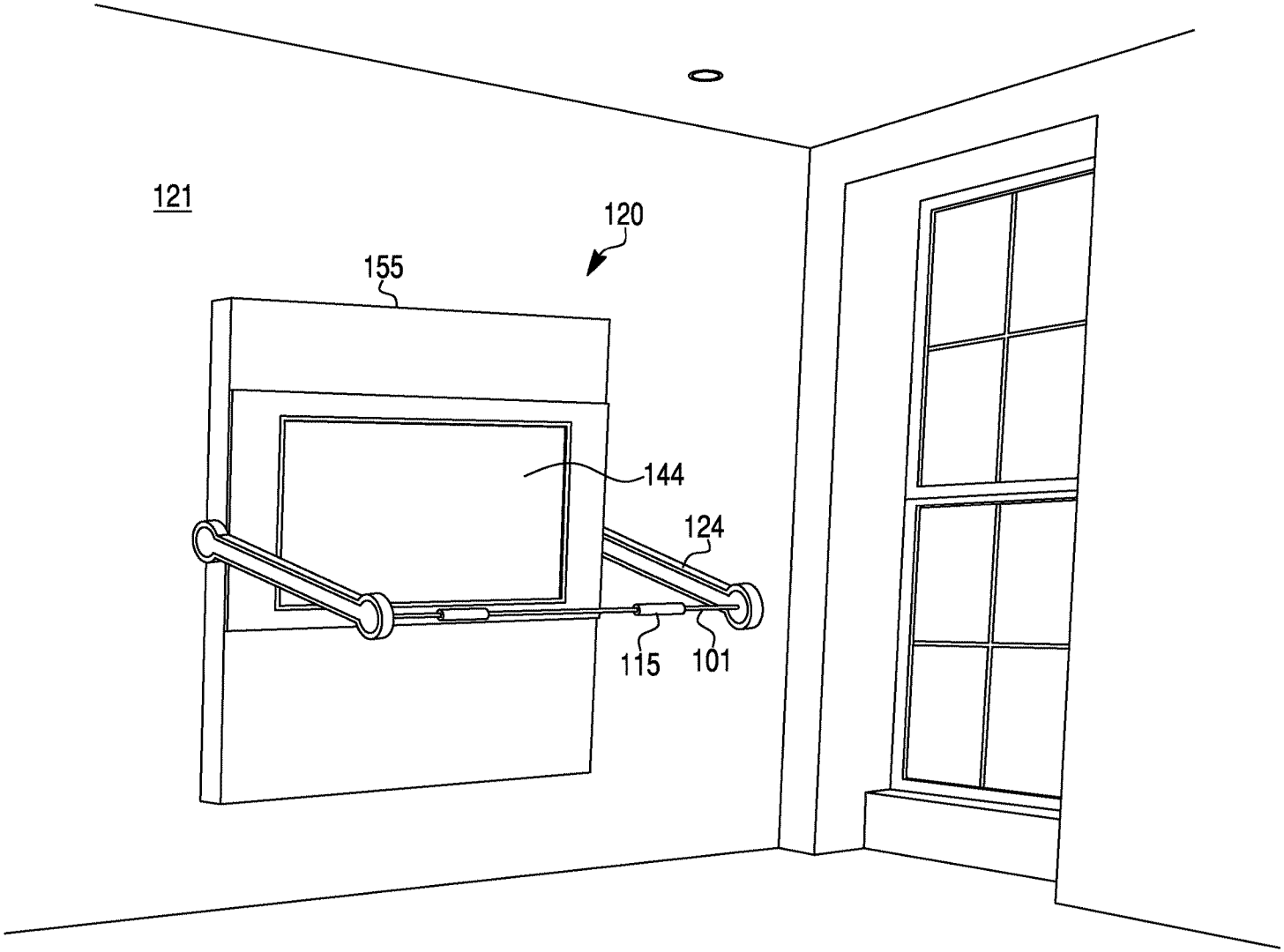
FIG. 13 is a representation of a wall mounted exercise device as shown in FIG. 12, including an instructor screen interface for guided exercise routines.

FIG. 13 shows an idealized version of the tension adjustable transversely extended wire exercise device 120 according to the present invention as shown in FIG. 12. The frame/guide elements 125 are incorporated into an enlarged self-contained wall-mounted frame 155. An elastic element 101 is shown suspended horizontally between the rotatively extended arm elements 124 and equipped with handgrips 115. The elastic band 101 height and tension adjustment features, to raise and lower arms 124 and tension band 101, are hidden within the wall mounted frame 155. In addition, a single control panel/user interface 144 is shown that displays and controls all aspects of the height, tension, and exercise routine. The device 120 may, optionally, have Internet capability for reporting to an exercise club, or monitoring medical professional, with respect to the workouts being performed or stored. The electronics may also include monitoring of heart rate, blood pressure, etc., provided through, for example, electronic signal sending handgrips 115 for measuring such vital signs of the user. An adjustable bench (not shown), having height and rake variability, would also likely be included. The fully framed device would be about 6-7 feet wide and mounted with an upper edge about 7-8 feet above the floor, and a lower edge 1.5-2 feet above the floor, e.g., sufficiently sized and positioned to enable full range of motion exercise from dead lifts to overhead presses.

In use, a user may manually adjust height and tension in accord with the selected exercise being accomplished. That is, a specific height for the transverse elastic element may be chosen for bench press type motion, arm curls, arm extensions, deadlift, or squat. These adjustments may be done manually, i.e., by moving a peg and sliding the trolley/sliding element on each side to a new peg hole and twist adjusting, or ratchet and pawl adjusting or electric reel adjusting, the tension in the band. The adjustment could be semi-automated wherein the user activates a stepper motor to drive the worm gear in the stanchion/sliding element to place the trolley/sliding element at a selected height, and thereafter engage a separate motorized winding drum to increase tension, or twist the band to create tension, and thereafter engage in the exercise movement. Or, alternatively, the user experience may be fully automated and also social. For example, a user identifies their user profile for the machine, User 1, and then selects a particular exercise routine already in the control center or downloads a sequence from an online provider. The sequence then initiates by automatically setting the height, i.e., 1 foot from the ground, and a tension of 150 lb equivalent, for dead lift reps. After the machine senses, either optically or thru a strain gauge, etc., that a rep sequence has been accomplished, the band re-sets for bench press at 3 feet height and 100 lb equivalent, following that sequence, it resets at 4.5 foot height for squats at a 200 lb equivalent tension, and lastly it resets to a 3.5 foot height and a 60 lb. equivalent for curls. These sequences can be unlimited in scope and variation. The exercise routines can be monitored remotely by a trainer or therapist or other medical professional. Limits for work, i.e., heart rate, breath rate, weight equivalent may be set with alarms or reminders to slow down, speed up, try harder, not exceed, etc. In this way, a user may feel encouraged and watched over, without the need to summon another person to observe the workout. Records of the workout may be forwarded to a group social site where comparison and contest(s) may be conducted, etc.

It should be understood that various changes and modifications to the presently disclosed embodiment as described herein will be apparent to those skilled in the art. Such changes and modifications may be made without departing from the spirit and scope of the present application and without diminishing its intended advantages.

The invention claimed is:

1. An exercise device, comprising:

a frame including at least two spaced guide members rigidly secured to an underlying support structure so as to maintain a fixed alignment between said guide members;

adjustable sliding members mounted so as to attach to and move along each of said guide members;

arm elements, extending away from said underlying support structure, mounted to each of said sliding members;

a transverse elastic element attached at each respective end thereof to a respective free end of each of said arm elements; and, at least one of said sliding members further including a tension adjuster connected to an end of said elastic element for increasing and decreasing the tension in the transverse elastic element.

2. A device as in claim 1, wherein:

said frame further includes additional elements, comprising a four-sided frame connecting respective upper and lowers ends of said spaced guide members one to the other.

3. A device as in claim 1, wherein:

said tension adjuster is adapted to electronically adjust the tension of said transverse elastic member in accord with user input.

4. A device as in claim 3, further comprising:

grips positioned on said elastic element for a user to engage said elastic element.

5. A device as in claim 4, wherein:

said grips are equipped with vital sign monitoring and signaling functionality.

6. A device as in claim 5, further comprising:

a control center for said device that includes elastic member height and tension information and vital sign monitoring from said grips.

7. A device as in claim 6, further comprising internet connectively between said control center and said device, wherein control center information regarding exercise programs and occurrence can be shared.

8. A device as in claim 3, wherein:

said slider element is electronically height adjustable.

9. A device as in claim 1, wherein:

said tension adjuster includes motor driven electronic adjustment.

* * * * *